US005826280A

United States Patent [19]

Bradley

[11] Patent Number: 5,826,280

[45] Date of Patent: Oct. 27, 1998

[54] DUAL SIZE BELT

[76] Inventor: Flavian E. Bradley, 8327 County, 503 CC Rd., Rapid River, Mich. 49878

[21] Appl. No.: 891,727

[22] Filed: Jul. 14, 1997

[51] Int. Cl.[6] ..... A41F 9/00

[52] U.S. Cl. ..... 2/322; 2/311

[58] Field of Search ..... 2/311, 312, 321, 2/322, 336, 338

[56] References Cited

U.S. PATENT DOCUMENTS 1,559,291 10/1925 Simmons ..... 2/322
1,833,175 11/1931 Pollock .
2,159,857 5/1939 Mix .
2,718,043 9/1955 Wallace ..... 2/322
2,916,742 12/1959 Sobel ..... 2/322
3,017,641 1/1962 Stollman .
3,828,370 8/1974 Ihmels .

*Primary Examiner*—Gloria M. Hale
*Attorney, Agent, or Firm*—Charles W. Chandler

[57] ABSTRACT

A belt adjustment assembly is provided having a belt body and a removable buckle including a latch. The belt body comprises a tongue end having a plurality of openings, and a buckle end having two longitudinally spaced slots, and fastening snaps. By moving the buckle from the belt and inserting the latch of the buckle through one of the slots, the functional length of the belt can be substantially enlarged or reduced to a desired length within a matter of seconds, without the need to punch additional holes in the belt.

3 Claims, 2 Drawing Sheets

DUAL SIZE BELT

TECHNICAL FIELD

This invention relates to an improved belt construction and more particularly to a dual size belt.

BACKGROUND OF THE INVENTION

Adjustable belts differ greatly in the manner in which their functional length is lengthened or shortened to accommodate various waist sizes. A user having a waist that substantially changes size usually has to purchase a belt that is either longer or shorter in length.

The prior art recognizes several constructions in which a belt buckle is detachable and/or adjustable. U.S. Pat. No. 1,833,175 discloses a belt having a single slit and multiple snaps to accommodate interchangeable buckles. U.S. Pat. No. 2,159,857 shows the use of a snap-on-type connecting member which permits the belt body to be removed and reversed. U.S. Pat. No. 3,017,641 shows another type of reversible belt which includes a keeper strap and a plurality of holes at the buckle end of the belt adjusting its length. U.S. Pat. No. 3,828,370 teaches the use of an elongated slit for adjustably positioning and securing a buckle along its length.

A need exists for an adjustable belt construction which is sturdy, economical, and can be adjusted to a substantial degree in an efficient manner.

SUMMARY OF THE INVENTION

It is a primary object of the present invention to provide a new and improved belt having alternate lengths.

A further object of the present invention is to provide a simple, reliable and economical improved adjustable belt construction in which the functional length of the belt can be considerably lengthened or shortened to accommodate weight gain or loss.

Another object of the present invention is to provide an improved dual length belt construction in which the adjustment can be accomplished without punching holes in the belt.

It is another object of the present invention to provide an improved dual length belt construction in which the material of the belt is not significantly worn after numerous shortening and lengthening adjustments.

In carrying out the above objects, a dual length belt construction is provided which includes a belt and a removable belt buckle. The belt has a tongue end with a plurality of openings, and a buckle end which has two slots and six snap fasteners. The buckle has a latch received in one of the slots. To change the belt length, the buckle is removed from the belt and the buckle latch inserted into the other slot in the belt. The functional belt length is changed in a matter of seconds, without punching additional holes in the belt.

The objects, features and advantages of the present invention are readily apparent to those skilled in the art from the following detailed description of the best modes for carrying out the invention

DESCRIPTION OF THE PREFERRED EMBODIMENT

Figure 1:
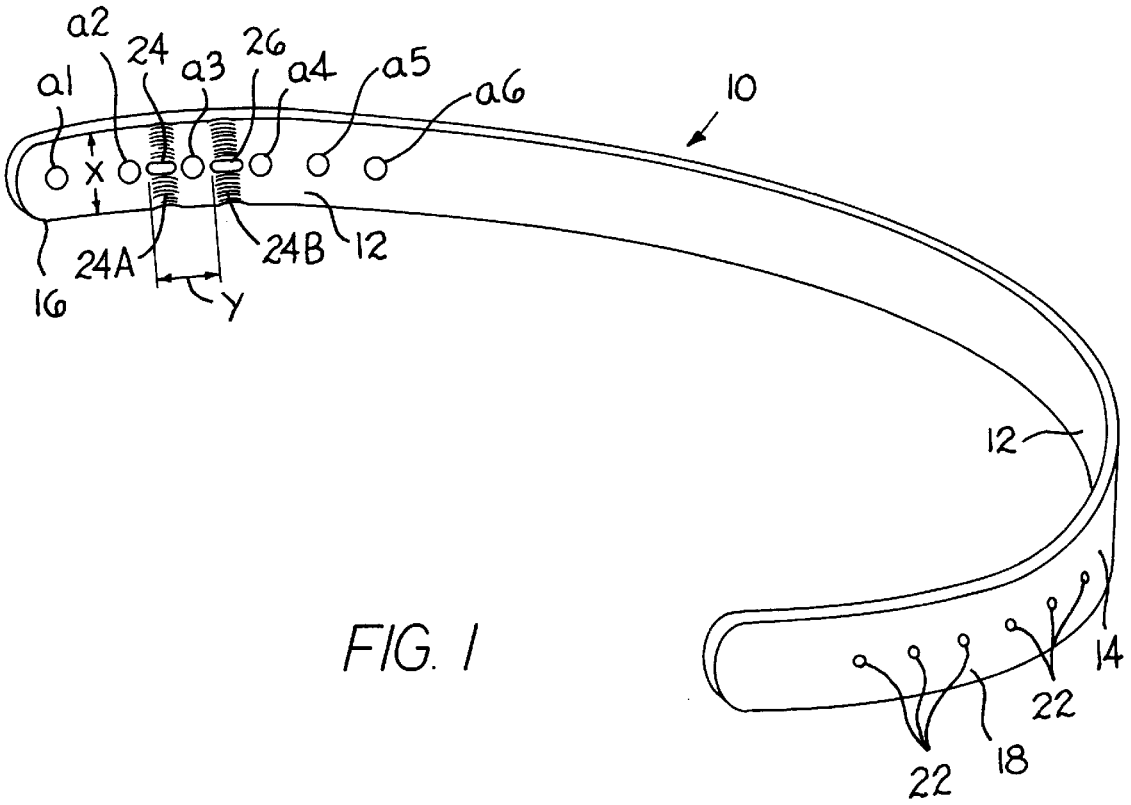
FIG. 1 is a perspective view of a preferred belt showing the first and second slots, the connecting snaps and the latch openings.
Figure 4:
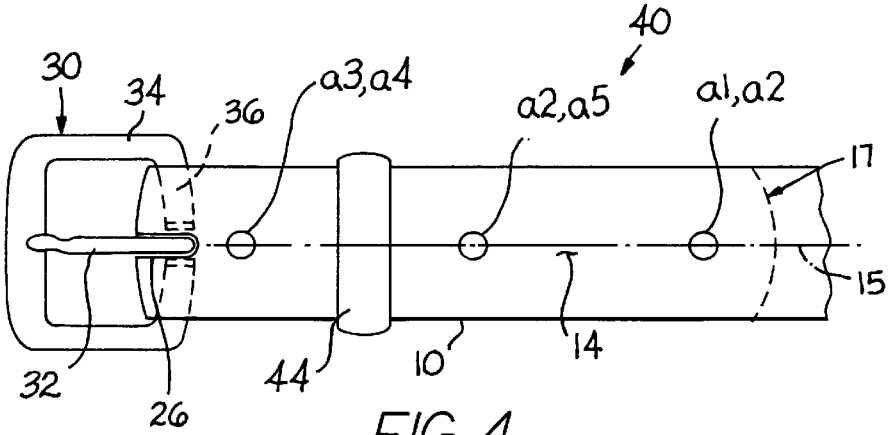
FIG. 4 is a fragmentary view of the belt assembly, with the buckle latch connected to the belt for a shorter functional belt length.
Figure 5:
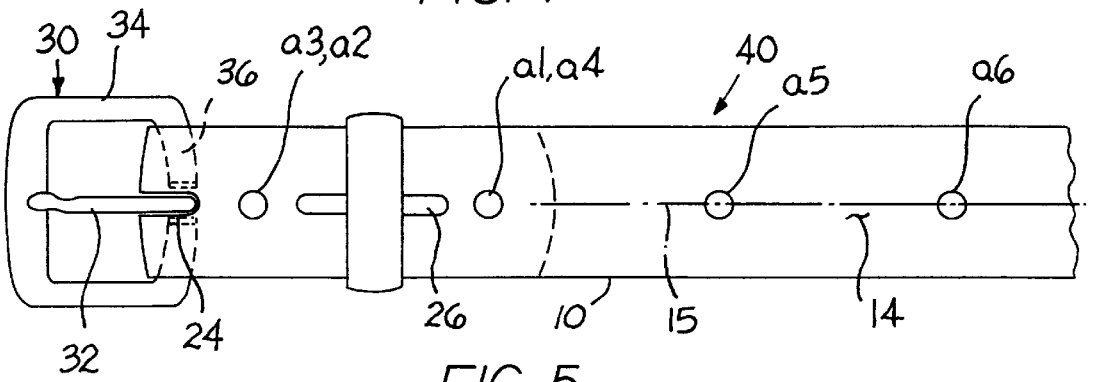
FIG. 5 is a fragmentary view of the belt assembly, the buckle latch connected to the other slot for a longer functional length.

Referring to the drawings in which like reference characters designate like elements, FIG. 1 shows a preferred leather belt 10. The body of the belt typically encircles the user's waist and includes both an inner body side 12 and an outer decorative side 14 which may be decorated in some manner. The belt has an integral buckle section 16, and a tongue section 18 located at opposite ends of the belt. Belt 10 may comprise any suitable belt material such as leather, imitation leather, fabric, plastic or the like. The distance designated by the line labeled × in FIG. 1, represents the width of the belt at buckle section 16. As shown in FIGS. 4 and 5, the belt has a longitudinal axis 15

Tongue end section 18 has a plurality of aligned, spaced holes 22. For function, as well as general appearance, openings 22 are one inch apart. The buckle section 16 includes a first slot 24 and a second slot 26 located on the belt longitudinal axis 15.The slots are ⅛th to 3/16ths of an inch wide and ⅞ths to 1 inch long. The thickness of the inside of the belt across its width at slots 24 and 26, as shown by shaded sections 24A and 24B, is reduced so the belt will more readily bend around the buckle frame.

Slots 24 and 26 are spaced 2 inches apart as indicated by line y. In addition to the slots, buckle section 16 has several snap fastener means. Referring to FIG. 1, the snap fastener means comprises male snap fasteners a1, a3, and a5 and female snap fasteners a2, a4, and a6. The snap fasteners are preferably small and have a color that complements the color of the belt.

Figure 2:
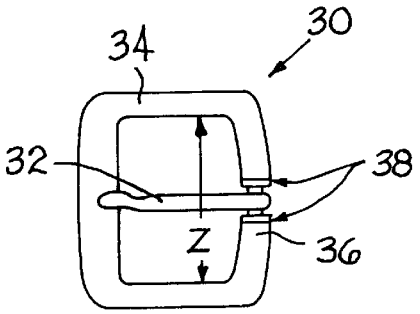
FIG. 2 is a front elevational view of a conventional belt buckle which can be used with the present invention.

FIG. 2 shows belt buckle 30. Buckle 30 is conventional and has a latch 32 which is generally secured to and is free to revolve about a buckle frame 34. Buckle frame 34 further includes an integral belt attachment post 36. The distance designated by line z represents the width of the buckle opening.

The latch can be inserted through openings 22 in tongue section 18. To fold buckle section 16 around post 36, the width of the buckle opening is slightly greater than the belt width.

Figure 3:
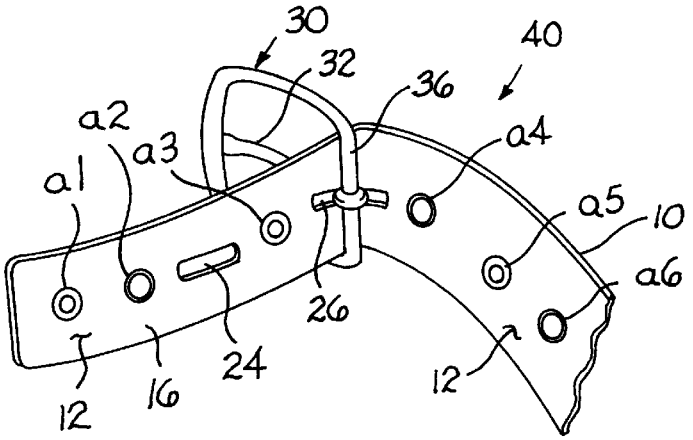
FIG. 3 is a perspective view of the belt assembly showing the buckle latch in the first slot of the belt.

Buckle 30 and belt 10 form belt assembly 40. As shown in FIG. 3 buckle section 16 is passed through the buckle opening and latch 32 inserted through either slot 24 or slot 26. The buckle section is folded around post or transverse frame element 36. In the "short" mode of the belt assembly 40, as shown in FIG. 4, latch 32 is inserted through slot 26 and male fastener a3 is attached to female fastener a4, male fastener as is attached to female fastener a2, and male fastener al is attached to female fastener a6.

In the "longers" mode of the belt assembly, as shown in FIG. 5, latch 32 is inserted through slot 24. To secure the buckle to the belt, male fastener a3 is attached to female fastener a2 while male fastener al is attached to female fastener a4.

By constructing belt assembly 40 as described, the functional length of the belt can be changed in a matter of seconds by unsnapping the various male and female fasteners, moving the buckle latch from one slot to another, and engaging the appropriate fasteners to either shorten or lengthen the belt by 2 inches. One advantage of this type of construction is that the user is not required to punch any additional holes to lengthen or shorten the belt.

Although the above description contains certain specific references to detailed information, such specificity should not be construed as limiting the scope of the invention, but as merely providing an illustration of some of the presently preferred embodiments of the invention. Obviously, numerous modifications and variations of the present invention are possible in light of the above teachings.

Having described my invention, I claim:

1. A dual length belt comprising:

an elongated belt having a thickness dimension and a width dimension;

said belt having side edges and a longitudinal centerline midway between said side edges;

said belt having a buckle end section (16) and a tongue end section (18); said tongue end section having a plurality of longitudinally-spaced openings (22) spaced therealong;

a buckle (30) having a rectangular frame (34) and a latch (32) swingably mounted on said frame for swinging motion on said longitudinal centerline;

said rectangular frame comprising a frame element (36) extending transverse to said longitudinal centerline; said latch being swingably attached to said frame element for entry into selected ones of said longitudinally spaced openings;

said buckle end section comprising at least two reduced thickness wall areas **(24*a* and 24*b*) spaced apart a predetermined distance, and a slot (24 or 26)** intersecting each reduced thickness wall area, each of said slots being located on the belt longitudinal axis to selectively receive said swingable latch;

a series of complementary snap fasteners (a1–a6) mounted on said buckle end section of said elongated belt; said snap fasteners comprising male and female fasteners alternating along the belt longitudinal axis;

the spacing between said reduced thickness wall areas being the same as the spacing between said snap fasteners; each of said reduced thickness wall areas being located midway between two of said snap fasteners;

said reduced thickness wall areas forming readily bendable areas of said belt, whereby said transverse frame element (36) can be selectively positioned against any one of said reduced thickness wall areas so that the belt can be trained around said frame element and formed into a loop configuration by snapping selected ones of said snap fasteners together.

2. The dual length belt of claim 1, wherein said elongated belt has an inner surface and an outer surface; each of said reduced thickness wall areas being formed by a depression in the belt inner surface; each of said depressions extending across the entire width dimension of said belt between the belt side edges.

3. The dual length belt of claim 2, wherein said elongated belt is formed of leather.

* * * * *